US011703022B2

(12) United States Patent
Kim et al.

(10) Patent No.: US 11,703,022 B2
(45) Date of Patent: Jul. 18, 2023

(54) FUEL INJECTOR

(71) Applicant: HYUNDAI KEFICO CORPORATION, Gunpo-si (KR)

(72) Inventors: Dong-Hyun Kim, Gyeonggi-do (KR); Hyung-Ik Kim, Gyeonggi-do (KR); Hyun-Jick Lee, Gyeonggi-do (KR)

(73) Assignee: Hyundai Kefico Corporation, Gunpo (KR)

( * ) Notice: Subject to any disclaimer, the term of this patent is extended or adjusted under 35 U.S.C. 154(b) by 261 days.

(21) Appl. No.: 17/021,635

(22) Filed: Sep. 15, 2020

(65) Prior Publication Data

US 2021/0148315 A1 May 20, 2021

(30) Foreign Application Priority Data

Nov. 14, 2019 (KR) ..... 10-2019-0146001

(51) Int. Cl.
*F02M 51/06* (2006.01)
*F02M 61/16* (2006.01)
*F02M 61/10* (2006.01)

(52) U.S. Cl.
CPC ..... *F02M 51/0671* (2013.01); *F02M 61/168* (2013.01); *F02M 61/10* (2013.01); *F02M 2200/08* (2013.01); *F02M 2200/9069* (2013.01)

(58) Field of Classification Search
CPC ..... F02M 2200/9069; F02M 2200/08; F02M 61/168; F02M 61/12; F02M 51/0671; F02M 2200/8061; F02M 61/10; F02M 61/16
USPC ..... 134/198
See application file for complete search history.

(56) References Cited

U.S. PATENT DOCUMENTS 6,409,102 B1 * 6/2002 Luttrell ..... F02M 61/14 239/585.4
2009/0301442 A1 * 12/2009 Reiter ..... F02M 61/168 239/585.1
2018/0142656 A1 * 5/2018 Oikawa ..... F02M 61/16

FOREIGN PATENT DOCUMENTS

JP 5307517 B2 10/2013
JP 2018025184 A 2/2018
JP 2018178945 A 11/2018

* cited by examiner

*Primary Examiner* — Christopher R Dandridge
(74) *Attorney, Agent, or Firm* — Fox Rothschild LLP

(57) ABSTRACT

A fuel injector is configured such that a non-magnetic member constituting a magnetic circuit is deformed by an axial force generated when the non-magnetic member is combined with a cover and a housing, thereby providing airtight contact. The fuel injector is a device that injects fuel into an engine by raising a needle. A magnetic field generated from a coil forms a magnetic circuit when the coil is magnetized, and the magnetic circuit raises the needle. The fuel injector includes a block ring disposed inside the coil, a cover disposed at an upper end of the block ring, and a housing disposed at a lower end of the block ring. The block ring is made of a non-magnetic material and configured to extend the magnetic circuit. When the cover and the housing are combined by being screwed together, the upper end and the lower end of the block ring are deformed to provide airtight contact with respect to the cover and the housing, respectively.

15 Claims, 6 Drawing Sheets

FUEL INJECTOR

CROSS REFERENCE TO RELATED APPLICATION

The present application claims under 35 U.S.C. § 119(a) the benefit of Korean Patent Application No. 10-2019-0146001, filed Nov. 14, 2019, the entire contents of which are incorporated by reference herein.

BACKGROUND

1. Technical Field

The present disclosure relates to a fuel injector configured such that anon-magnetic member constituting a magnetic circuit is deformed by an axial force generated when the non-magnetic member is combined with a cover and a housing, thereby providing airtight contact surfaces.

2. Description of the Related Art

A fuel injector injects fuel into an engine. The fuel injector includes a coil that is magnetized while being powered, and the magnetized coil raises a needle so that fuel can be injected into the engine.

When the coil is magnetized, a magnetic circuit is constructed. When the fuel injector is made of only a magnetic member, the magnetic circuit may be constructed before a portion of a magnetic field reaches an armature, resulting in a decrease in the magnetic force. This inhibits the magnetic circuit from achieving maximum efficiency. Since the magnetic circuit does not achieve maximum efficiency, responsiveness of the fuel injector is deteriorated.

In order to solve this problem, a non-magnetic member is provided to locally cut off the magnetic circuit so that the magnetic field can be fully directed toward the armature.

In a conventional high-pressure fuel injector, since the armature moves up and down under a high-pressure condition, a magnetic member, a non-magnetic member, and another magnetic member disposed in series are required to be installed with high coaxiality and high surface evenness. In order to achieve the high coaxiality and surface evenness, laser welding is used to manufacture such a high-pressure fuel injector. However, due to a trend that fuel injection systems including fuel injectors use an increased pressure, it becomes difficult to join parts to be exposed to high pressures. The non-magnetic member is fabricated usually through metal injection molding (MIM). However, this method has a problem in that dimensional accuracy is poor and post-processing processing is required.

SUMMARY

The present disclosure provides a fuel injector configured such that a non-magnetic member serving as a component to control a magnetic circuit is tightly assembled with adjacent members with the help of an axial force, thereby ensuring airtight contact between the non-magnetic member and the adjacent members.

In order to accomplish the above objective, one aspect of the present disclosure provides a fuel injector configured in a manner that a magnetic field generated from a coil that is magnetized by an electric current supplied to the coil forms a magnetic circuit and the magnetic circuit raises a needle so that fuel is injected into an injection target, the fuel injector including: a block ring disposed inside the coil, made of a non-magnetic material, and configured to extend the magnetic circuit; a cover disposed at an upper end of the block ring; and a housing disposed at a lower end of the block ring. When the cover and the housing are coupled to each other by being screwed together, the upper end and the lower end of the block ring are deformed to make airtight contact with respect to the cover and the housing, respectively.

The upper and lower ends of the block ring may have respective convex-curved portions and may be deformed to form airtight contact when the cover and the housing are coupled to each other.

Each of the upper end and the lower end of the block ring may have a convex-curved portion that is formed between the inner circumference and the outer circumference of the block ring.

At each of the upper end and the lower end of the block ring, the convex-curved portion may be near the outer circumference than the inner circumference of the block ring.

The upper end of the block ring and a lower end of the cover may be convex toward each other. When the cover and the housing are coupled to each other, the upper end of the block ring and the lower end of the cover may be deformed to form an airtight contact therebetween.

A height of the convex-curved portion at the upper end of the block ring and a height of the convex-curved portion of the lower end of the cover may be determined (i.e., may vary) depending on a coupling force between the cover and the housing, the coupling force ensuring internal pressure resistance required for the fuel injector.

The height of the convex-curved portion at the upper end of the block ring and the height of the convex-curved portion of the lower end of the cover may be determined (i.e., may vary) depending on materials of the block ring and the cover.

The peak point of the convex-curved portion at the upper end of the block ring may correspond to the peak point of the convex-curved portion at the lower end of the cover.

The lower end of the block ring may be provided with a convex-curved portion and an upper end of the housing may be provided with a convex-curved portion. The convex-curved portions of the block ring and the housing may be convex toward each other. When the cover and the housing are coupled to each other, the convex-curved portion of the lower end of the block ring and the convex-curved portion of the upper end of the housing may be deformed to form an airtight contact.

The height of the convex-curved portion at the lower end of the block ring and the height of the convex-curved portion of the housing may be determined (i.e., may vary) depending on a coupling force between the cover and the housing, the coupling force ensuring internal pressure resistance required for the fuel injector.

The height of the convex-curved portion at the lower end of the block ring and the height of the convex-curved portion of the housing may be determined (i.e., may vary) depending on materials of the block ring and the housing.

The peak point of the convex-curved portion at the lower end of the block ring may correspond to the peak point of the convex-curved portion at the housing.

The cover and the housing may be screwed until the inner circumference of the upper end of the block ring and the inner circumference of the lower end of the block ring come into contact with the cover and the housing, respectively.

Each of the upper end and the lower end of the blocking may be provided with a step-up portion between the inner circumference and the outer circumference.

Each of the upper end and the lower end of the block ring may be provided with a step-up portion that is closer to the inner circumference than the outer circumference of the block ring and which further protrudes than the convex-curved portion in an axial direction.

At the upper end of the block ring, a portion closer to the inner circumference of the block ring may further protrude upward than a portion closer to the outer circumference of the block ring. At the lower end of the cover, a portion closer to the outer circumference of the cover may further protrude downward than a portion closer to the inner circumference of the cover.

At the lower end of the block ring, a portion closer to the inner circumference of the block ring may further protrude downward than a portion closer to the outer circumference of the block ring. At the upper end of the housing, a portion closer to the outer circumference of the cover may further protrude upward than a portion closer to the inner circumference of the housing.

At each of the upper end and the lower end of the block ring, a portion between the outer circumference of the block ring and the step-up portion may be convex-curved.

The fuel injector may further include a retaining nut that is composed of a lower portion configured to accommodate the housing and an upper portion configured to be screwed with the cover.

The fuel injector may further include an outer ring provided inside the retaining nut, in which the outer ring is made of a magnetic material and is in contact with the housing and the cover.

As described above, the fuel injector of the present disclosure has a configuration in which when the block ring made of a non-magnetic material is combined with an adjacent member, the block ring is deformed by an axial force, thereby forming an airtight contact with the adjacent member. Therefore, a welding process is not necessary to form the airtight contact between the block ring and the adjacent member.

Welding is difficult to perform and causes a change in dimensions of components that are to welded to each other. Therefore, in the case of the fuel injector of the present disclosure, the cover and the housing are combined preferably through screw threads, instead of welding, which can result in problems in the related art.

In addition, since the block ring is hermetically combined with an adjacent member by the axial force generated when the cover and the housing are combined, the internal pressure resistance of the fuel injector is increased.

In addition, a solenoid unit is provided in the form of a module resulting from assembling the block ring, the housing, the cover, and a coil. Therefore, a magnetic circuit is provided as a module. In addition, it is easy to assemble the solenoid unit, and quality control of the fuel injector becomes simplified.

DESCRIPTION OF THE PREFERRED EMBODIMENTS

Figure 1:
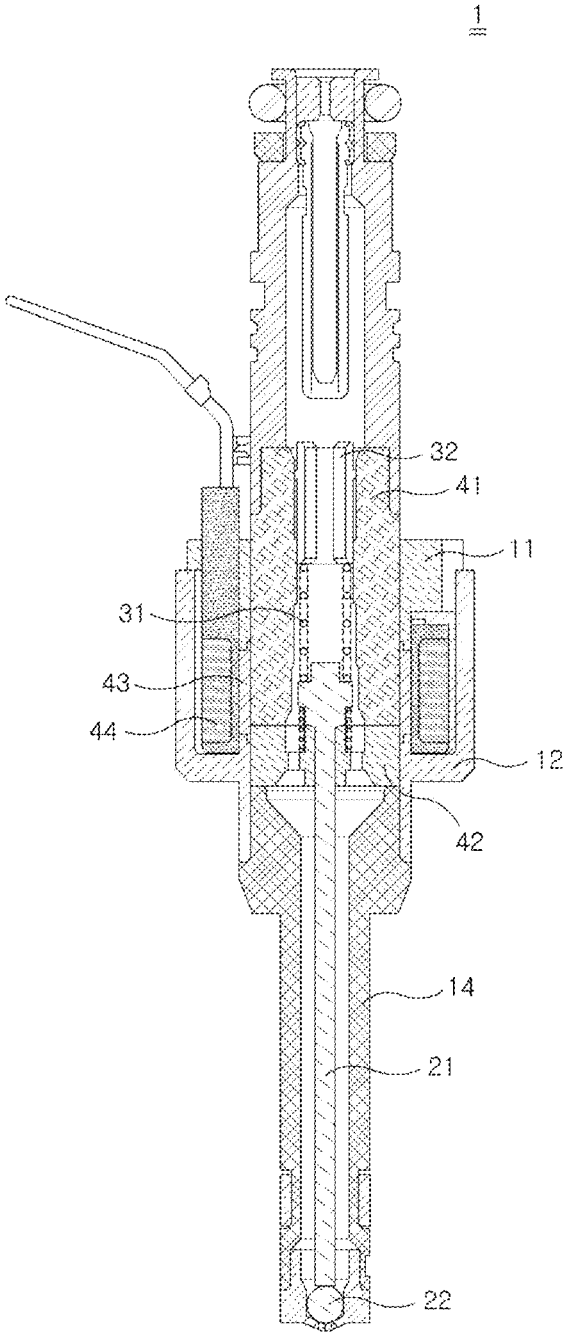
FIG. 1 is a cross-sectional view illustrating a fuel injector according to one embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Hereinafter preferred embodiment of the present disclosure will be described in detail with reference to the accompanying drawings.

A fuel injector 1 according to one embodiment of the present disclosure is a device that injects fuel into an injection target such as an engine by raising a needle 21. Specifically, a magnetic field generated from a coil 44 that is magnetized as being supplied with an electric current forms a magnetic circuit which raises the needle 21. The fuel injector includes a block ring 43 disposed inside the coil 44, a cover 11 disposed at an upper end of the block ring 43, and a housing 12 disposed at a lower end of the block ring 43. The block ring 43 is made of a non-magnetic material and configured to extend the magnetic circuit. When the cover 11 and the housing 12 are combined by being screwed together, the upper end and the lower end of the block ring 43 are deformed to provide airtight contact with respect to the cover 11 and the housing 12, respectively.

The fuel injector 1 is connected to a fuel supply pipe. The fuel injector 1 is configured to supply fuel to a cylinder or a fuel injection port according to a control signal.

Specifically, when the needle 21 that is installed to move up and down in the fuel injector 1 is raised, a ball valve 22 provided at a lower end of the needle 21 opens so that a spray hole formed at a lower end of a carrier 14 is exposed. Therefore, fuel can be sprayed through the spray hole.

The fuel injector 1 includes a solenoid unit. The solenoid unit includes the coil 44 that is magnetized when being powered. The magnetized coil 44 enables fuel to be sprayed.

Figure 2:
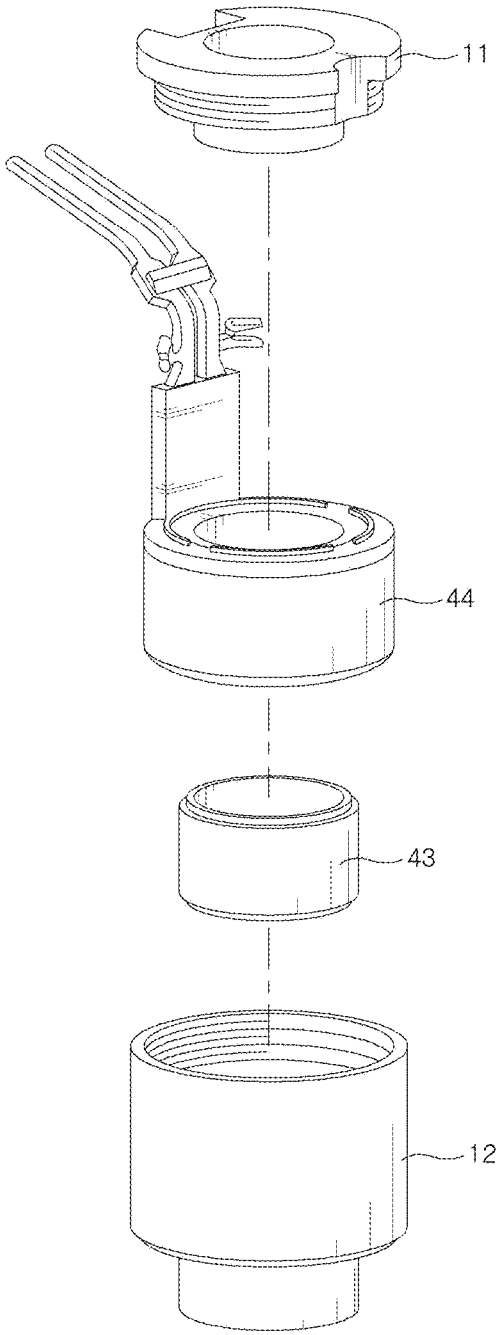
FIG. 2 is an exploded perspective view illustrating a cover, a block ring, and a housing that are parts of the fuel injector according to one embodiment of the present disclosure.

Referring to FIG. 2, the solenoid unit includes: the coil 44 that forms a magnetic circuit when being magnetized; and the cover 11 and the housing 12 that are used to mount the coil 44. Specifically, the solenoid unit further includes the block ring 43 functioning to cut off the magnetic circuit. Since the block ring 43 is made of a non-magnetic material, the block ring 43 can block the flow of a magnetic field generated from the coil. Thus, the block ring 43 prevents the magnetic field from directly propagating through the cover 11 instead of passing through the armature 42. That is, the magnetic field is confined to be directed toward the armature 42 so that the magnetic force is maximally increased by the armature 42. This improves the responsiveness of the fuel injector 1.

The center of the solenoid unit is provided with a magnetic core 41 and the armature 42. The armature 42 is combined with the needle 21. An upper end of the needle 21 is provided with a compression spring that elastically biases the needle 21 downward while the coil is not supplied with electric current. That is, the compression spring prevents fuel from being sprayed out when the coil 44 is not supplied with electric current. An upper end of the compression spring 31 is provided with an adjustment tube 32 that is fastened to the magnetic core 41 and which is configured to adjust the spring force of the compression spring 31.

When electric current is not supplied, the compression spring 31 presses the needle 21 downward so that the ball valve 22 disposed at the lower end of the needle 21 blocks the spray hole. That is, when the fuel injector is not powered, fuel cannot be injected into the engine.

When the fuel injector is powered, the coil 44 is magnetized to form the magnetic circuit. This makes the armature 42 and the needle 21 move upward. As the needle 21 moves upward, the spray hole is opened so that fuel can be sprayed out through the spray hole. When the fuel injector is powered, that is, electric current is supplied to the coil 44, the magnetic circuit is formed by the housing 12, the cover 11, the magnetic core 41, and the armature 42 all of which are made of a magnetic material. If the fuel injector is made of only a magnetic material, a portion of the magnetic field generated from the coil 44 may not be directed toward the armature 42 but may be directed toward the cover 11. Thus, a loss of the magnetic field occurs.

In order to solve this, in the present disclosure, the solenoid unit includes a block ring 43 made of a non-magnetic material. The block ring enables the magnetic field to be concentrated on the armature 42, thereby maximizing the efficiency of the magnetic field.

When the block ring 43 is assembled to form the solenoid unit, the cover 11 and the housing 12 disposed respectively at the upper end and the lower end of the block ring 43 are tightly screwed so that the airtight contact is formed between the upper end of the block ring 43 and the cover 11 and between the lower end of the block ring 43 and the housing 12. The upper end of the block ring 43 and the lower end of the cover 11 which face each other are convex toward each other, and the lower end of the block ring 43 and the upper end of the housing 12 which face each other are convex toward each other. However, when the cover 11 and the housing 12 are combined by being screwed together, the contact portions between the block ring 43 and the cover 11 and between the block ring 43 and the housing 12 are deformed to provide a hermetic structure.

The construction of the solenoid unit will be described in greater detail with reference to FIGS. 2 and 3. The cover 11, the block ring 43, and the housing 12 are combined. The coil 44 that is magnetized when supplied with electric current is installed to surround the block ring 43.

The order in which the solenoid unit is assembled will be described. First, the cover 11 and the block ring 43 are arranged in place, the coil 44 is inserted, the housing 12 is placed under the block ring 43, and the cover 11 and the housing 12 are screwed to each other (see a portion C in FIG. 4).

In the fuel injector 1, when high-pressure fuel is supplied, the armature 42 may be pushed upward. Therefore, high coaxiality and surface evenness are required. In the solenoid unit, the cover 11, the block ring 43, and the housing 12 are arranged in this order, in which the cover 11 and the housing 12 are made of a magnetic material and the block ring 43 is made of a non-magnetic material. Thus, a magnetic body, a non-magnetic body, and a magnetic body are disposed in this order. In the assembly, the contact portion between the block ring 43 and the cover 11 and the contact portion between the block ring 43 and the housing 12 are required to be hermetic. To this end, the block ring 43, the cover 11, and the housing 12 are tightly assembled using an axial force so that hermetic contact is formed between the block ring 43 and the cover 11 and the block ring 43 and the housing 12. In order to form hermetic contact by deforming the contact portions of the components to be combined using the axial force, the upper end and the lower end of the block ring 43 are convex-curved. The convex-curved portions of the block ring 43 are deformed to be flat by the axial force generated when the cover 11 and the housing 12 are combined by being screwed together. To this end, the upper end and the lower end of the block ring 43 are convex-curved ends. In addition, the lower end of the cover 11 and the upper end of the housing 12, which respectively come into contact with the upper end and the lower end of the block ring 43, are also convex-curved ends.

Since the counterpart ends of the components are convex toward each other, the counterpart convex-curved portions P first come into contact with each other at an early stage of assembling and next become flat due to the axial force at the last stage of assembling of the cover 11 and the housing 12. Thus, airtight contact surfaces S are formed. The screwing the cover 11 and the housing 12 continues until the inner circumference of the upper end of the block ring 43 and the inner circumference of the lower end of the block ring 43 meet the cover 11 and the housing 12.

The axial force is applied due to screwing together of the cover 11 and the housing 12, thus combining respective screw threads, and the upper end and the lower end of the block ring 43 are deformed between the cover 11 and the housing 12. Thus, hermetic surfaces are formed at the upper end and the lower end of the block ring 43 (see portions A and B in FIG. 4).

Figure 3:
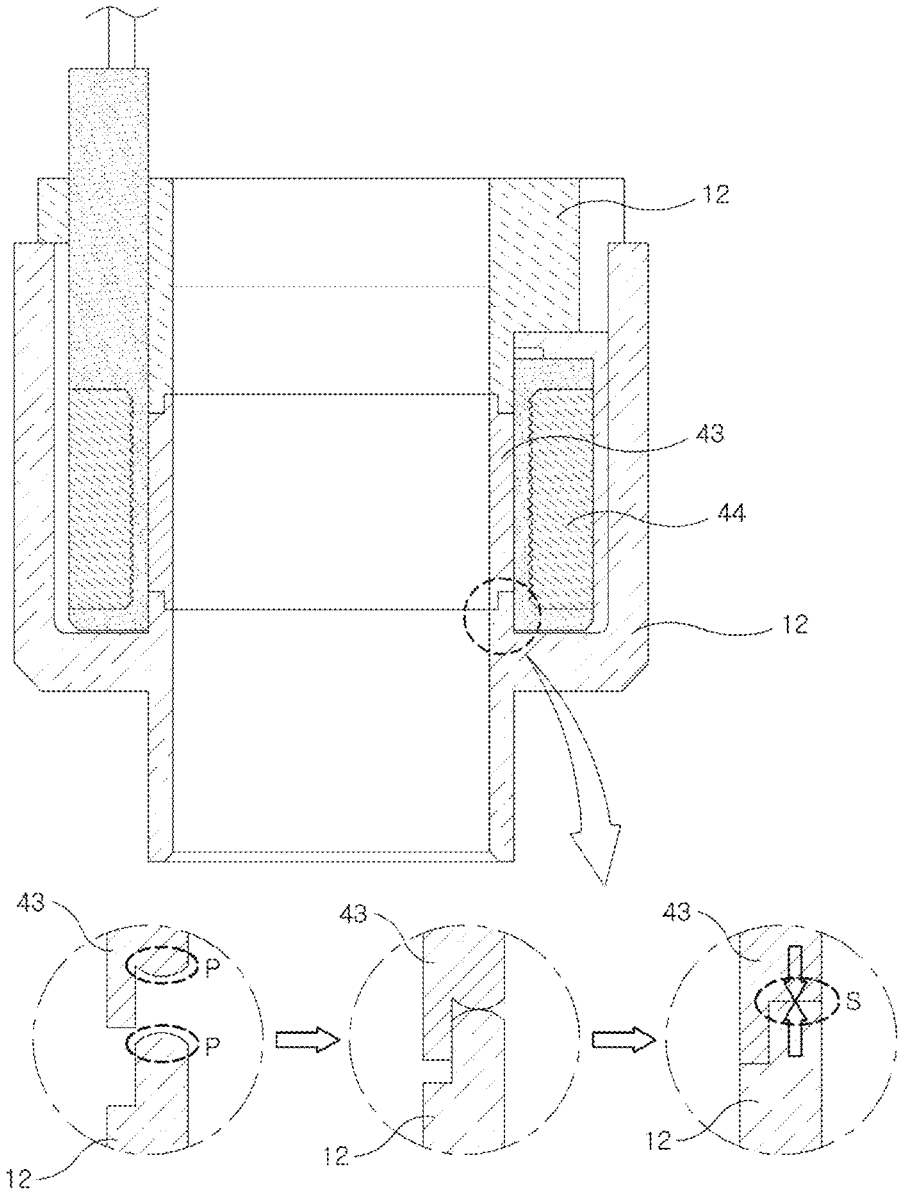
FIG. 3 is a cross-sectional view illustrating an assembled structure of the cover, the block ring, and the housing that are parts of the fuel injector according to one embodiment of the present disclosure.

FIG. 3 illustrates the lower end of the block ring 43 and the upper end of the housing 12 which are to be hermetically combined. The counterpart ends, i.e., the lower end of the block ring 43 and the upper end of the housing 12, are convex toward each other before being assembled. When starting screwing the cover 11 and the housing 12, the block ring 43 comes into contact with the housing 12. As the screwing progresses, the counterpart convex-curved surfaces that are in contact with each other are deformed to be flat. That is, the airtight contact S is formed between the block ring 43 and the housing 12.

Each of the upper end and the lower end of the block ring 43 is a convex-curved end. That is, at each of the upper end and the lower end of the block ring 43, the end face between the inner circumference and the outer circumference is partially convex-curved. Specifically, at each of the upper end and the lower end of the block ring 43, the convex curved portion is closer to the outer circumference than the inner circumference.

The upper end of the block ring 43 and the lower end of the cover 11 are convex toward each other. When the cover 11 and the housing 12 are combined by being screwed together, the upper end of the block ring 43 and the lower end of the cover 11 are deformed to be flat, thereby forming the airtight contact.

Likewise, the lower end of the block ring 43 and the upper end of the housing 12 are convex toward to each other. When the cover 11 and the housing 12 are combined by being screwed together, the lower end of the block ring 43 and the upper end of the housing 12 are deformed to be flat, thereby forming the airtight contact.

A height of each of the convex-curved portions (i.e., the upper end of the block ring 43, the lower end of the cover 11, the lower end of the block ring 43, and the upper end of the housing 12) is determined depending on the force of screwing the cover 11 and the housing 12 when the cover 11 and the housing 12 are coupled to exhibit pressure resistance required for the fuel injector 1. As the screwing force is increased, the height of the convex-curved portion is increased.

Alternatively, the height of each of the convex-curved portions (i.e., the upper end of the block ring 43, the lower end of the cover 11, the lower end of the block ring 43, and the upper end of the housing 12) may be determined depending on the materials of the block ring 43, the cover 11, and the housing 12. That is, as the rigidity of each of the materials is increased, the height of each of the convex-curved portions is decreased. On the contrary, as the rigidity is decreased, the height is increased.

The height of the peak point of the convex curve of the upper end of the block ring 43 is preferably equal to the height of the peak point of the convex curve of the lower end of the cover 11. The height of the peak point of the convex curve of the upper end of the block ring 43 is preferably equal to the height of the peak point of the convex curve of the upper end of the housing 12.

Figure 4:
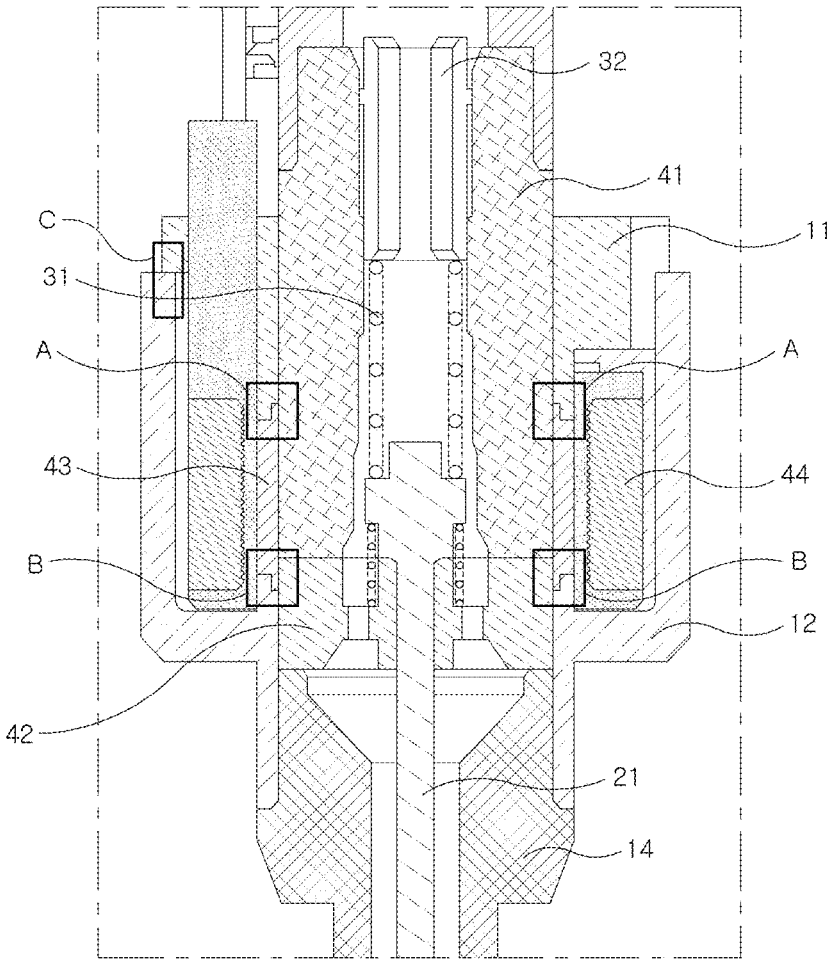
FIG. 4 is a cross-sectional view illustrating the vicinity of the block ring of the fuel injector according to one embodiment of the present disclosure.

FIG. 4 illustrates the lower end of the block ring 43 and the upper end of the housing 12 which are to be hermetically combined. The convex-curved portions at the lower end of the block ring 43 and the upper end of the housing 12 come into contact with each other, and the convex-curved curved portions are then deformed to be flat, thereby providing an airtight contact between the block ring 43 and the housing 12.

In addition, each of the upper end and the lower end of the block ring 43 has a step-up portion to further improve airtightness. The upper end of the block ring 43 which is to be combined with the lower end of the cover 11 and the lower end of the block ring 43 which is to be combined with the upper end of the housing 12 are step-shaped to improve the airtightness. Specifically, at each of the upper end and the lower end of the block ring 43, a portion near the inner circumference is longer than a portion near the outer circumference. This structure improves the airtight contact when the block ring 43 is assembled with the cover and the housing. That is, at the upper end of the block ring 43, the portion near the inner circumference further protrudes than the portion near the outer circumference. On the contrary, at the lower end of the cover 11, which is a portion to mate with the upper end of the block ring 43, a portion near the outer circumference further protrudes than a portion near the inner circumference. At the lower end of the block ring 43, the portion near the inner circumference further protrudes than the portion near the outer circumference, and at the upper end of the housing 12, a portion near the outer circumference further protrudes than a portion near the inner circumference.

At each of the upper end and the lower end of the block ring 43, the step-up portion is a portion near the inner circumference of the block ring 43, and the convex-curved portion is a portion near the outer circumference of the block ring 43. That is, a portion between the outer circumference of the block ring 43 and the step-up portion is convex-curved.

Figure 5:
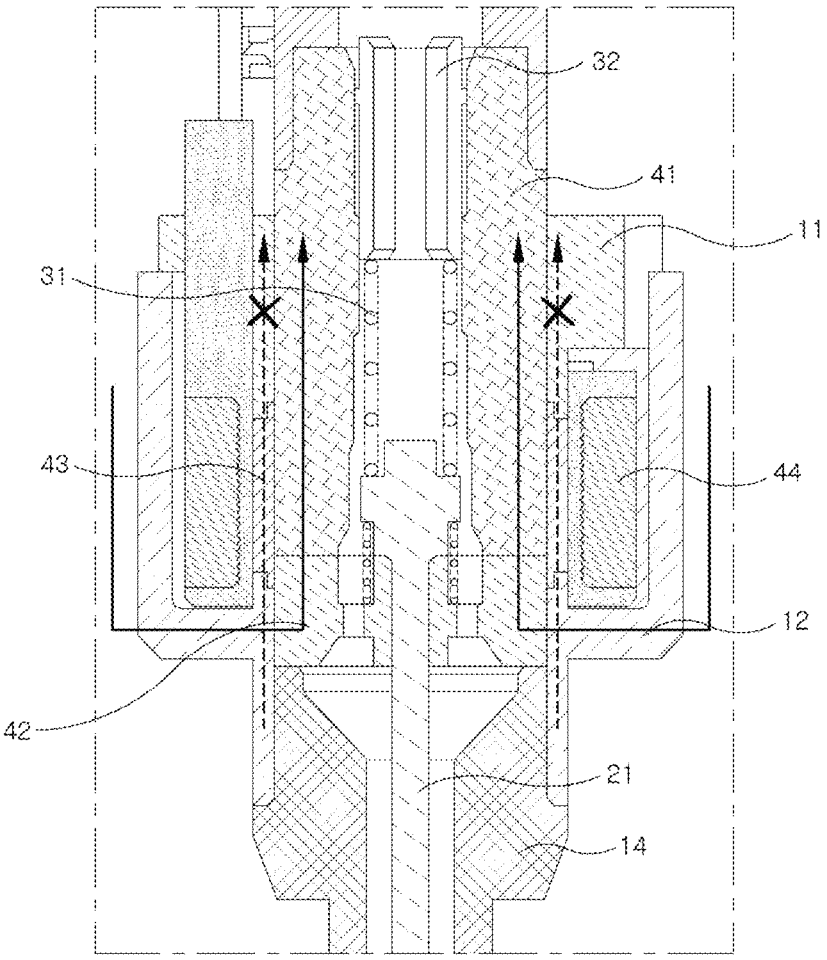
FIG. 5 is a diagram illustrating a magnetic circuit formed around the block ring of the fuel injector according to one embodiment of the present disclosure.

When electric current is supplied to the coil 44, the flow of the magnetic field toward the housing 12 or the cover 11 is blocked and is guided to the armature 42. Thus, the magnetic field is maximally concentrated on the armature 42 (see FIG. 5).

The fuel injector 1 constructed as described above has improved pressure-resisting capability compared with exiting fuel injectors. Therefore, the fuel injector 1 of the present disclosure can be applied to a gasoline direct injection (GDI) engine in which high-pressure fuel is injected into an engine. In this application, the fuel injector 1 injects fuel into the cylinder of the engine.

Figure 6:
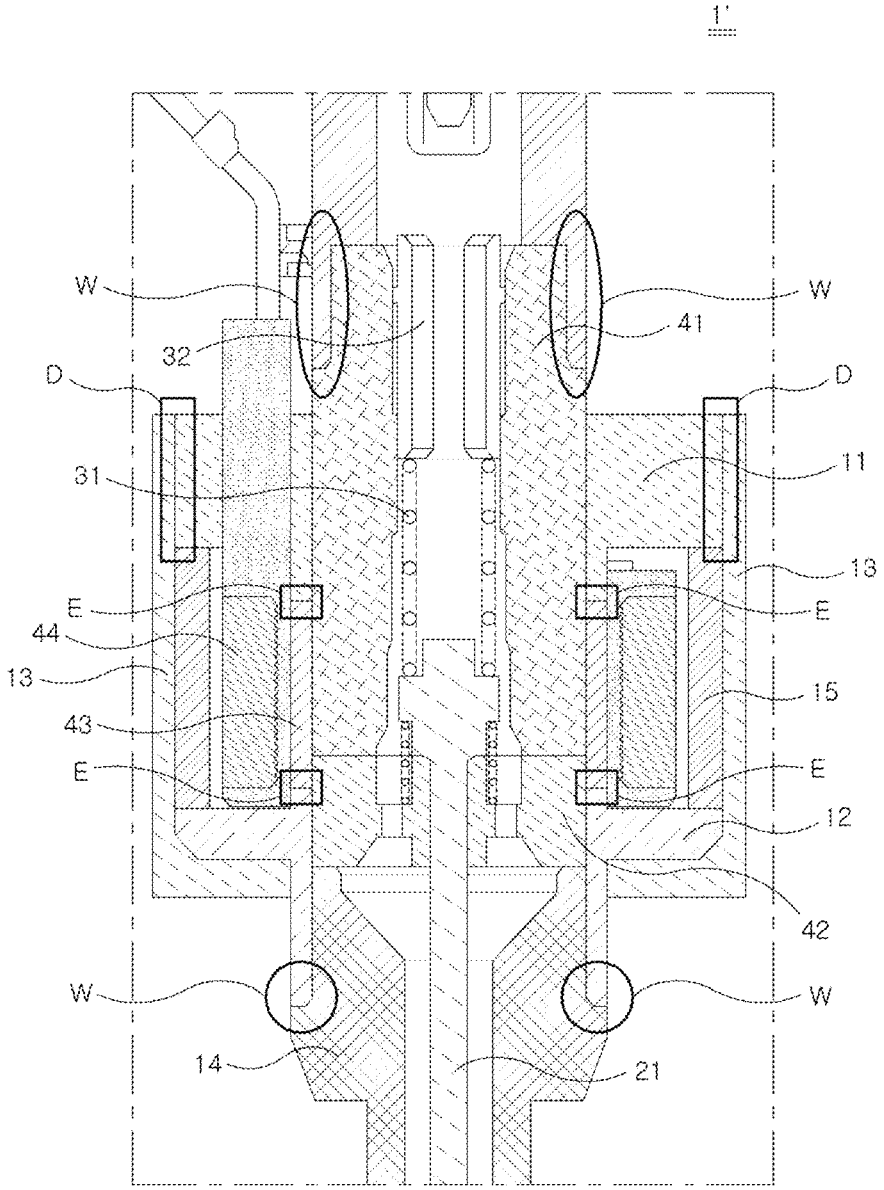
FIG. 6 is an enlarged cross-sectional view illustrating a main portion of a fuel injector according to another embodiment of the present disclosure.

FIG. 6 illustrates a fuel injector according to another embodiment of the present disclosure.

The structure of a fuel injector 1' according to this embodiment is fundamentally the same as the structure of the fuel injector 1. The only difference between the fuel injector 1' and the fuel injector 1 is that the fuel injector 1' includes a housing 12 and a retaining nut 13 instead of the housing of the fuel injector 1.

The retaining nut 13 is disposed outside the housing 12. The retaining nut 13 and the housing 12 are combined. In addition, an external ring 15 is inserted into the retaining nut 15. The external ring 15 is installed to be in contact with the inside surface of the retaining nut 13.

A lower portion of the retaining nut 13 is shaped to accommodate the housing 12 and an upper portion of the retaining nut 13 is threaded. Thus, the inside surface of the upper end portion of the retaining ring 13 and the external surface of the upper end portion of the cover 11 are screwed with each other (see a portion D of FIG. 6). When the retaining nut 13 and the cover 11 are screwed with each other, an axial force is generated. Due to this axial force, the upper end and the lower end of a block ring 43 are deformed to form airtight contact (see portions E of FIG. 6). The upper end and the lower end of the block ring 43 and counterparts to be respectively combined with the upper end and the lower end of the block ring 43 are all convexly curved. The convexly curved portions are deformed by the axial force that is generated when the retaining nut 13 and the cover 11 are screwed with each other, thereby providing airtight contact.

The housing 12, the retaining nut 13, and the external ring 15 are made of a magnetic material. Therefore, a magnetic circuit formed by a series connection of the housing 12, the retaining nut 13, the cover 11 or a series connection of the housing 12, the external ring 15, and the cover 11 is formed. Alternatively, due to the presence of the external ring 15, the retaining nut 13 may be made of a non-magnetic material.

In FIG. 6, a portion designated by the reference character "W" is a weld joint.

While the present disclosure has been described with respect to the specific embodiments, it will be apparent to those skilled in the art that various changes and modifications may be made without departing from the spirit and scope of the present disclosure as defined in the following claims. Accordingly, it should be noted that such alternations or modifications fall within the claims of the present disclosure, and the scope of the present disclosure should be construed on the basis of the appended claims.

What is claimed is:

1. A fuel injector configured such that a coil magnetized by an electric current supplied to the coil generates a magnetic field, and a magnetic circuit formed by the magnetic field raises a needle so that fuel is able to be ejected, the fuel injector comprising:

a block ring disposed inside the coil, wherein the block ring is configured to cut off a flow of the magnetic field and to direct the magnetic field toward an armature;

a cover disposed at an upper end of the block ring; and a housing disposed at a lower end of the block ring;

wherein each of the upper end and the lower end of the block ring is provided with a step-up portion between an inner circumference and an outer circumference of the block ring;

wherein the step portion includes a convex-curved portion at each of the upper end and the lower end formed adjacent to the outer circumference of the blocking ring and a flat portion at each of the upper end and the lower end formed adjacent to the inner circumference of the blocking ring;

wherein the convex-curved portion formed at the upper end and the lower end at the outer circumference of the block ring are deformed to make air tight contact between the cover and the housing when the cover and the housing are combined due to an axial force by being screwed together;

wherein the flat portion of the step-up portion is closer to the inner circumference than the out circumference of the block ring and further protrudes than the convex-curved portion in an axial direction; and wherein, at the upper end of the block ring, the convex-curved portion closer to the inner circumference of the block ring further protrudes upward than the flat portion closer to the outer circumference of the block ring, and at the lower end of the cover, the flat portion closer to the outer circumference of the cover further protrudes downward than the convex-curved portion closer to the inner circumference of the cover.

2. The fuel injector according to claim 1, wherein the deformed convex-curved portions of the upper end and the lower end of the blocking are configured to form airtight contact surfaces at the outer circumference of the block ring.

3. The fuel injector according to claim 2, wherein the convex-curved portion at each of the upper end and the lower end of the blocking is closer to the outer circumference than the inner circumference.

4. The fuel injector according to claim 1, wherein a lower end of the cover includes a convex-curved portion toward the convex-curved portion of the block ring, and when the cover and the housing are combined, the upper end of the block ring and the lower end of the cover are deformed to form an airtight contact.

5. The fuel injector according to claim 4, wherein a height of the convex-curved portion at the upper end of the block ring and a height of the convex-curved portion of the lower end of the cover vary depending on a coupling force between the cover and the housing, the coupling force ensuring internal pressure resistance required for the fuel injector.

6. The fuel injector according to claim 4, wherein a height of the convex-curved portion at the upper end of the block ring and a height of the convex-curved portion of the lower end of the cover vary depending on materials of the block ring and the cover.

7. The fuel injector according to claim 4, wherein a peak point of the convex-curved portion at the upper end of the block ring corresponds to a peak point of the convex-curved portion at the lower end of the cover.

8. The fuel injector according to claim 1, wherein an upper end of the housing includes a convex-curved portion toward the convex-curved portion of the block ring, and when the cover and the housing are combined, the convex-curved portion of the lower end of the block ring and the convex-curved portion of the upper end of the housing are to form an airtight contact.

9. The fuel injector according to claim 8, wherein a height of the convex-curved portion at the lower end of the block ring and a height of the convex-curved portion of the housing vary depending on a coupling force between the cover and the housing, the coupling force ensuring internal pressure resistance required for the fuel injector.

10. The fuel injector according to claim 8, wherein a height of the convex-curved portion at the lower end of the block ring and a height of the convex-curved portion of the housing vary depending on materials of the block ring and the housing.

11. The fuel injector according to claim 8, wherein a peak point of the convex-curved portion at the lower end of the block ring corresponds to a peak point of the convex-curved portion at the housing.

12. The fuel injector according to claim 1, wherein the cover and the housing are screwed until the inner circumference of the upper end of the block ring and the inner circumference of the lower end of the block ring come into contact with the cover and the housing, respectively.

13. The fuel injector according to claim 1, wherein at the lower end of the block ring, the convex-curved portion closer to the inner circumference of the block ring further protrudes downward than the flat portion closer to the outer circumference of the block ring, and at the upper end of the housing, the flat portion closer to the outer circumference of the cover further protrudes upward than the convex-curved portion closer to the inner circumference of the housing.

14. The fuel injector according to claim 1, further comprising a retaining nut that is composed of a lower portion configured to accommodate the housing and an upper portion configured to be screwed with the cover.

15. The fuel injector according to claim 14, further comprising an outer ring provided inside the retaining nut, wherein the outer ring is made of a magnetic material and is in contact with the housing and the cover.

* * * * *